US006293338B1

(12) United States Patent
Chapman et al.

(10) Patent No.: US 6,293,338 B1
(45) Date of Patent: Sep. 25, 2001

(54) GAS TURBINE ENGINE RECUPERATOR

(75) Inventors: William I. Chapman, Beverly Hills; Samuel B. Williams, Bloomfield Hills, both of MI (US)

(73) Assignee: Williams International Co. L.L.C., Walled Lake, MI (US)

( * ) Notice: Subject to any disclaimer, the term of this patent is extended or adjusted under 35 U.S.C. 154(b) by 0 days.

(21) Appl. No.: 09/433,445

(22) Filed: Nov. 4, 1999

(51) Int. Cl.[7] ..... F28F 3/00

(52) U.S. Cl. ..... 165/166; 165/167; 165/170; 60/39.512; 60/39.52

(58) Field of Search ..... 165/52, 165, 166, 165/DIG. 356, 170; 60/39.07, 39.17, 39.182, 39.511, 39.512, 39.52

(56) References Cited

U.S. PATENT DOCUMENTS

| | | | | |
|---|---|---|---|---|
| 1,662,870 | | 3/1928 | Stancliffe | 165/166 |
| 1,825,498 | | 9/1931 | Wogan | 165/157 |
| 2,643,512 | | 6/1953 | Stalker | 60/39.161 |
| 2,650,073 | | 8/1953 | Holm | 165/140 |
| 2,925,714 | | 2/1960 | Cook | 60/39.161 |
| 3,216,495 | | 11/1965 | Johnson | 165/166 |
| 3,228,464 | | 1/1966 | Stein et al. | 165/166 |
| 3,507,115 | * | 4/1970 | Wisoka | 165/166 |
| 3,741,293 | | 6/1973 | Haberski | 165/166 |
| 3,818,984 | | 6/1974 | Nakamura et al. | 165/166 |
| 3,831,374 | | 8/1974 | Nicita | 60/39.51 R |
| 4,049,051 | | 9/1977 | Parker | 165/166 |
| 4,073,340 | | 2/1978 | Parker | 165/166 |
| 4,098,330 | | 7/1978 | Flower et al. | 165/166 |
| 4,183,403 | * | 1/1980 | Nicholson | 165/166 |
| 4,338,998 | * | 7/1982 | Goloff | 165/165 |
| 4,438,809 | * | 3/1984 | Papis | 165/166 |
| 4,974,413 | | 12/1990 | Szego | 60/39.511 |
| 5,004,044 | | 4/1991 | Horgan et al. | 165/145 |
| 5,050,668 | | 9/1991 | Peterson et al. | 165/81 |
| 5,082,050 | | 1/1992 | Darragh | 165/81 |
| 5,105,617 | | 4/1992 | Malohn | 60/39.511 |
| 5,279,358 | | 1/1994 | Hannis | 165/103 |
| 5,323,603 | * | 6/1994 | Malohn | 60/39.511 |
| 5,388,398 | | 2/1995 | Kadambi et al. | 60/39.511 |
| 5,555,933 | * | 9/1996 | Darragh et al. | 165/166 |
| 5,855,112 | | 1/1999 | Bannai et al. | 60/39.511 |
| 6,066,898 | * | 5/2000 | Jensen | 290/52 |
| 6,112,403 | * | 9/2000 | Ervin et al. | 29/726 |

* cited by examiner

*Primary Examiner*—Ira S. Lazarus
*Assistant Examiner*—Terrell McKinnon
(74) *Attorney, Agent, or Firm*—Dinnin & Dunn P.C.

(57) ABSTRACT

A recuperator for a gas turbine engine comprises a plurality of cells that are orientated in an annular array and attached to one another at only the radially inner edges thereof. Each cell comprises a high pressure plate having spaced integral ribs thereon defining a plurality of low temperature compressed air passages and a low pressure plate having a plurality of spaced ribs defining a plurality of high temperature exhaust gas passages.

23 Claims, 2 Drawing Sheets

FIG. 1.
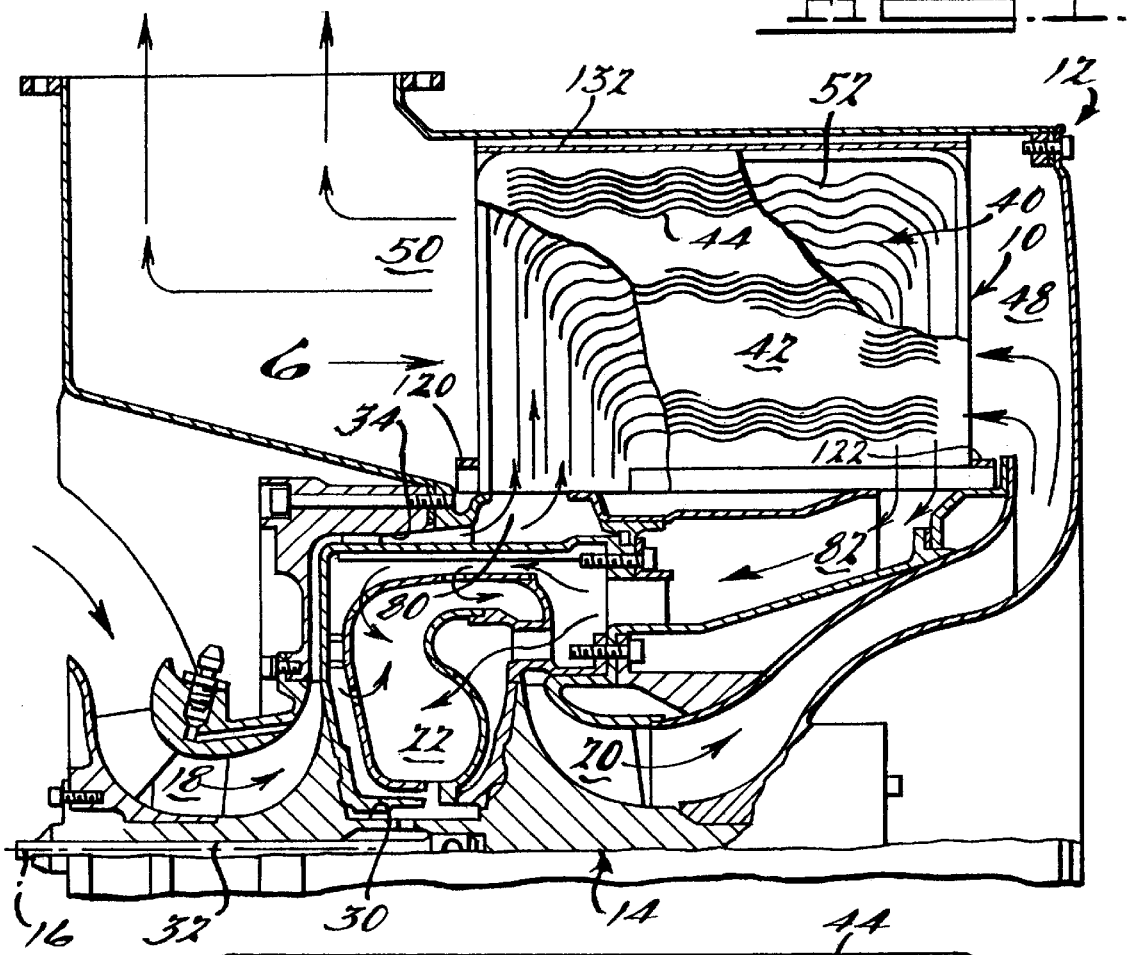
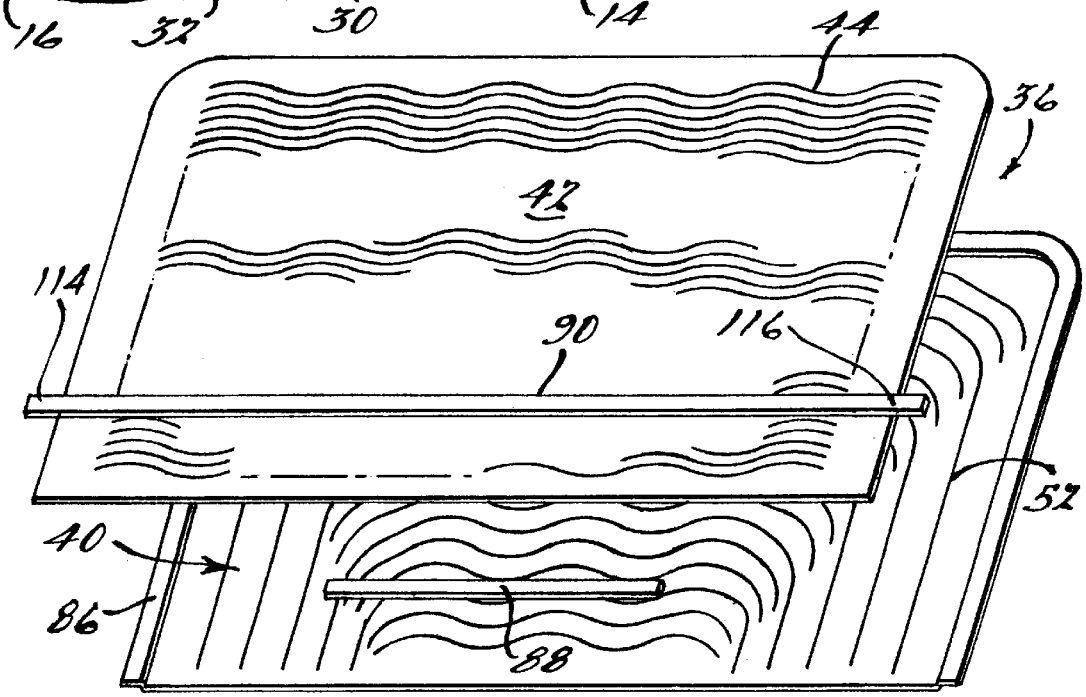
FIG. 2.

GAS TURBINE ENGINE RECUPERATOR

The recuperator of a gas turbine engine transfers heat from the relatively hot, low pressure engine exhaust gas to incoming, relatively cold, high pressure compressed air. The recuperator enables the gas turbine engine to approach the fuel economy of a diesel engine as well as to exhibit emission levels below ULEV standards. Moreover, such relatively low emission levels can be achieved by recuperator equipped gas turbine engines without the use of a catalytic converter.

However, known recuperators, particularly metallic plate-and-fin recuperators of the type disclosed in U.S. Pat. No. 3,507,115, are one of the most expensive components of a gas turbine engine. In addition, known recuperators exhibit a relatively high temperature and pressure gradient across the high pressure air side of the recuperator which causes poor flow distribution which compromises efficiency. Yet another deficiency of known gas turbine engine recuperators, is that conventional seals are often employed between the hot and cold sections of the recuperator which rapidly degrade in the gas turbine engine environment.

SUMMARY OF THE INVENTION

The aforesaid problems are solved by the gas turbine engine recuperator of the present invention. The recuperator comprises an annular matrix of cells, each of which comprises a ribbed high pressure plate that is welded to a ribbed low pressure plate. In an exemplary constructed embodiment, the cells are orientated in an annular array having an inside diameter of 10.00 inches, an outside diameter of 16.12 inches, and an overall axial length of 6.30 inches. Both the high and low pressure plates of the cells are formed from, for example, 0.003-inch thick stainless steel sheet material. Ribs are stamped in the plates to a height of, for example, 0.024 inches to define fluid flow channels between the plates.

After welding of a high pressure plate to a low pressure plate to form a cell, the cell is formed to the involute curve having a base circle diameter equal to or somewhat less than the inner diameter of the annular recuperator matrix. Thereafter, the radially inner edges of the cells are welded to one another. The cells are restrained at the radially outer edges thereof, in free floating relation, by an outer shell.

In operation, relatively cold, high pressure air follows a "C" shaped flow path through the recuperator. Initial flow of air is radially outwardly from the engine compressor into a compressed air intake manifold, thence axially through the recuperator matrix, thence radially inwardly through a compressed air exit manifold to the engine combustor.

Low pressure, relatively high temperature exhaust gas flows radially outwardly from the engine turbine, thence axially through the recuperator matrix in counterflow relation to the flow of cold, high pressure combustion air, thence radially outwardly to atmosphere.

The inventive concept underlying the recuperator of the present invention is that each ribbed plate forms a high aspect ratio primary heat transfer element that is in direct contact with both fluids. The ribs control the spacing between the plates of each cell as well as the spacing between adjacent cells. In addition, the ribs accept fluid pressure loads between the counterflow passages. The ribs follow an undulating path arranged so that ribs in adjacent plates prevent nesting. Each low pressure plate has a rib pattern on the exterior thereof that, in combination with the high pressure plate of an adjacent cell, defines a low pressure exhaust gas flow path between the cells.

In accordance with one feature of the invention, spacing of the radially extending ribs on the high pressure plate of each cell varies longitudinally so as to define radially extending channels of different width. The different widths of the radial channels renders flow in each complete passage, namely, two radial channels plus an axial channel, equal at design conditions. Stated in another manner, the longer, radially outer, axially extending channels connect to the wider, radially extending channels thereby equalizing total flow resistance through the recuperator. This equality of flow in the channels at design conditions results in uniform heat transfer from the low pressure, high temperature, exhaust gas to the lower temperature compressed air which, in turn, permits the heat exchanger to more nearly approach its theoretical optimum heat transfer rate.

BRIEF DESCRIPTION OF THE DRAWINGS

FIG. 1 is a fragmentary sectional elevation of a gas turbine engine having a recuperator in accordance with the present invention;

FIG. 2 is an exploded perspective view of the high and low pressure plates of the recuperator of FIG. 1 prior to being welded to one another to form a cell and formed to an involute configuration.

DETAILED DESCRIPTION OF THE PREFERRED EMBODIMENT OF THE INVENTION

Figure 4:
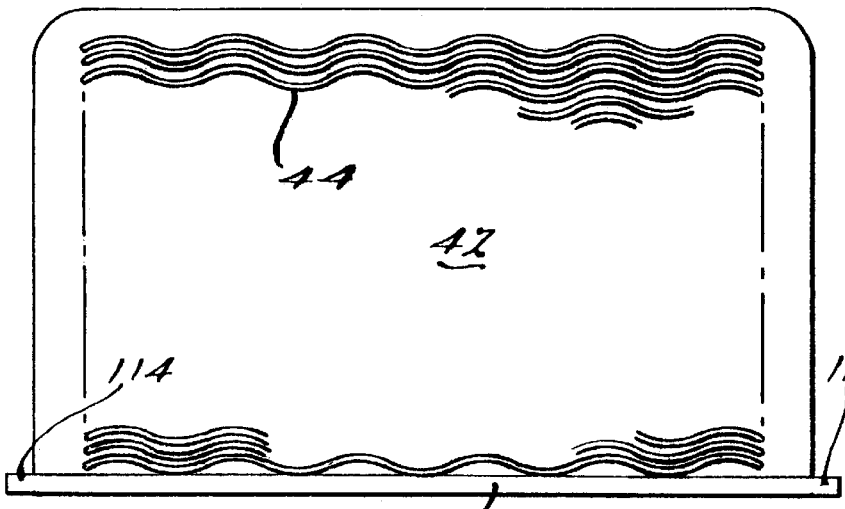
FIG. 4 is a view taken in the direction of the arrow 4 of FIG. 3.
Figure 3:
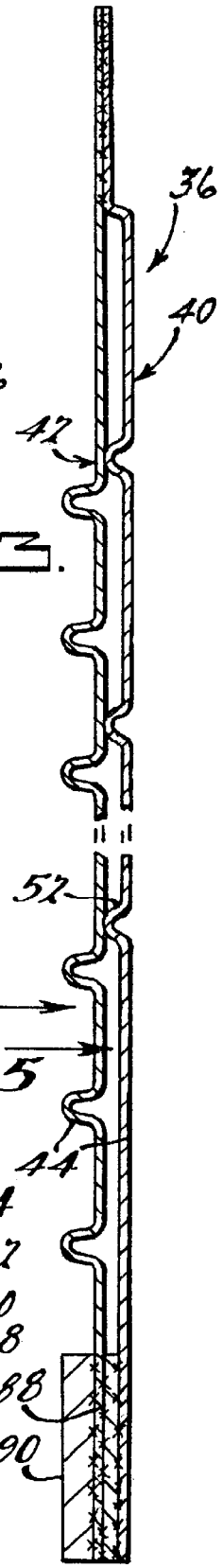
FIG. 3 is a view of the plates of FIG. 2 in the assembled condition prior to being formed to the involute configuration.

As seen in FIG. 1 of the drawings, a recuperator 10, in accordance with a preferred constructed embodiment of the present invention, is shown in the environment of a conventional gas turbine engine 12. The engine 12 comprises a shaft assembly 14, that extends along a central axis 16 of the engine 12 and connects a forwardly disposed compressor section 18, to a rearwardly disposed turbine section 20. An annular combustor 22 is disposed radially outwardly of the shaft assembly 14 between the compressor section 18 and turbine section 20. The shaft assembly 14 is adapted to be connected to, for example, power generation equipment (not shown) to utilize shaft horsepower generated by the engine 12. A conventional rotatable fuel slinger 30 is disposed on a cylindrical axially extending slinger sleeve 32 which is part of the rotating shaft assembly 14.

In operation, rotation of the shaft assembly 14 and fuel slinger 30 effects the discharge of fuel radially outwardly into the combustor 22. Atmospheric air, at ambient temperature, is drawn into the compressor section 18. The relatively cool compressed air then flows radially outwardly through a high pressure air channel 34 to the recuperator 10, wherein the air is heated. The heated high pressure air then flows axially to the combustor 22 and, after combustion, through the turbine 20.

In accordance with the present invention, the recuperator 10 comprises an annular matrix of cells 36 each of which comprises a high pressure plate 40 and a low pressure plate 42.

Each low pressure plate 42 is provided with a plurality of undulating relatively closely spaced ribs 44 that are stamped into the surface thereof to a height of, for example, 0.040 inches. Channels defined by the ribs 44, in combination with the high pressure plate 40 of an adjacent cell 36, communicate at one end with a hot exhaust gas inlet plenum 48 and at an opposite end with a cooled exhaust gas outlet plenum 50 which, in turn, vents to atmosphere.

Each high pressure plate 40 has a plurality:y of ribs 52 thereon that are stamped to a height of, for example, 0.024 inches, in a "C" shaped array which, in conjunction with a low pressure plate 42 of the cell 36, define channels 92–102 that communicate with a compressed air inlet plenum 80 and channels 104–114 at an opposite end that communicate with a heated compressed air outlet plenum 82. The ribs 52 in the "bight" portion of the high pressure plate 40 undulate in generally parallel counterflow relation to the ribs 44 on the low pressure plate 42 but do not nest therein.

The high pressure plate 40 has a flanged edge portion 86 of equal height to the ribs 52 thereon which, in combination with a relatively short spacer bar 88, provide welding surfaces for joining the plates 40 and 42 as well as to direct high pressure air flow first radially outwardly from the cool compressed air plenum 80, thence parallel to the central axis 16 of the engine 12, thence radially inwardly to the heated compressed air exit plenum 82 and combustor 22 of the engine 12.

The low pressure plate 42 is provided with a full length spacer bar 90 on the radially inner edge thereof to facilitate welding to the radially inner edge of the high pressure plate 40 of an adjacent cell 36 as well as to direct exhaust gas from the exhaust gas inlet plenum 48 to the exhaust gas exit plenum 50 thence to atmosphere. The spacer bars 90 extend beyond the low pressure plate 42 to engage rings 120 and 122 that are used for mounting the recuperator on the engine.

Figure 5:
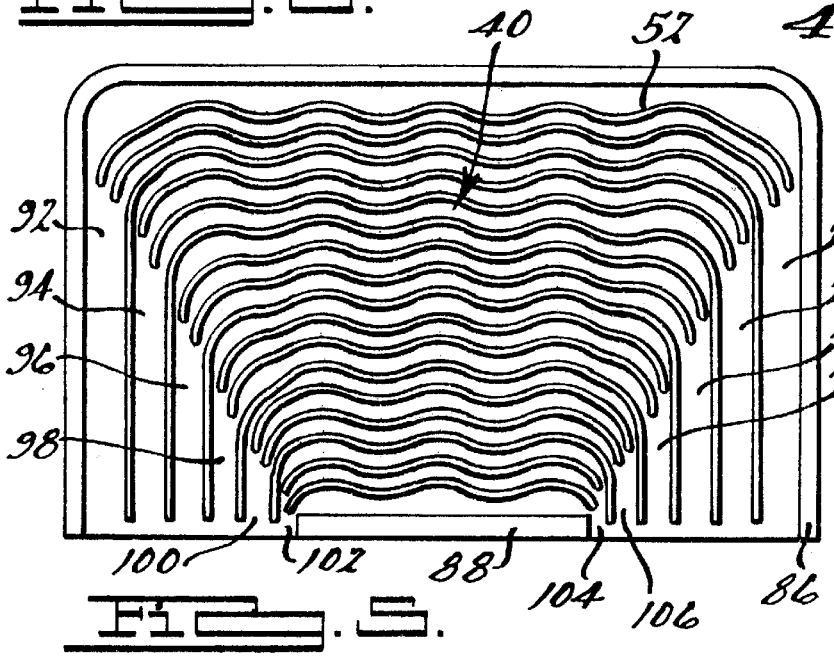
FIG. 5 is a view taken in the direction of the arrow 5 of FIG. 3.

In accordance with one feature of the present invention, and as best seen in FIG. 5, the longitudinal spacing between the radially extending ribs 52 defining high pressure air inlet channels 92–102 and outlet channels 104–114 increases in relation to the total length of the C-shaped flow path consisting of two radial passages and the connecting axial passage to make flow through the individual C-shaped passages equal at the design conditions of temperature and pressure. This equality of flow causes the heat transfer rate to be uniform in the radial direction.

Figure 6:
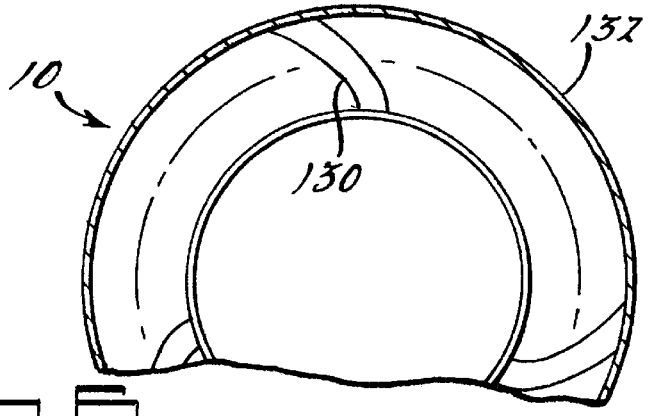
FIG. 6 is a view taken in the direction of the arrow 6 of FIG. 1.

Assembly of the recuperator 10 requires only that each cell 36 be bent to the involute curve 130, shown in FIG. 6, and that a plurality of cells 36 be thereafter stacked in an annular array and welded to one another at the radially inner edges thereof. The annular matrix of cells 36 is encompassed by a cylindrical shell 132 that permits float of the cells 36 relative thereto. The shell 132 is also the outer wall for the exhaust gas passage through the recuperator. The recuperator is mounted in the turbine engine 12 so as to communicate with the compressed air and exhaust gas passages thereof.

While the preferred embodiment of the invention has been disclosed, it should be appreciated that the invention is susceptible of modification without departing from the scope of the following claims.

What is claimed is:

1. A recuperator for a gas turbine engine comprising:

a plurality of cells disposed in juxtaposed relation to one another in an annular array, each of said cells comprising a high pressure plate having spaced integral ribs thereon defining a plurality of spaced high pressure air channels; and a low pressure plate welded to said high pressure plate and having a plurality of spaced integral ribs which, in combination with the high pressure plate of an adjacent cell, define a plurality of low pressure exhaust gas channels, wherein either at least two of said plurality of high pressure air channels or at least two of said plurality of low pressure exhaust gas channels constitute a plurality of channels having different lengths, and a spacing between ribs of at least a portion of a longer of said plurality of channels having different lengths is larger than a spacing between ribs of at least a portion of a shorter of said plurality of channels having different lengths.

2. A recuperator for a gas turbine engine in accordance with claim 1 wherein the ribs on said high pressure plate are orientated in a "C" shaped array defined by radially extending leg portions and axially extending bight portions, respectively, the ribs on said low pressure plate extending generally parallel to the ribs on the bight portion of the high pressure plate.

3. The recuperator of claim 1 comprising a peripheral flange on said high pressure plate the same height as the ribs thereon to facilitate welding thereof to said low pressure plate.

4. The recuperator of claim 3 comprising a high pressure plate spacer bar on the radially inner periphery of said high pressure plate intermediate the radially extending ribs thereon so as to define an air inlet to said cell and an air outlet from said cell.

5. The recuperator of claim 4 wherein said high pressure plate spacer bar is the same height as the flange on said high pressure plate.

6. The recuperator of claim 1, wherein each said cell is formed to an involute curve.

7. The recuperator of claim 1, wherein said integral ribs defining said plurality of spaced high pressure air channels have substantially uniform heights from said high pressure plate, or said integral ribs defining said plurality of low pressure exhaust gas channels have substantially uniform heights from said low pressure plate.

8. The recuperator of claim 1, wherein at least a portion of said integral ribs defining said plurality of spaced high pressure air channels follows an undulating pattern, or at least a portion of said integral ribs defining said plurality of low pressure exhaust gas channels follows an undulating pattern.

9. The recuperator of claim 1, wherein at least a portion of a spaced integral rib of a high pressure plate of a first cell is located between spaced integral ribs of a low pressure plate of a second cell adjacent to said high pressure plate of said first cell, and at least a portion of a spaced integral rib of a low pressure plate of said first cell is located between spaced integral ribs of a high pressure plate of a third cell adjacent to said low pressure plate of said first cell.

10. A recuperator for a gas turbine engine comprising:

a plurality of cells disposed in juxtaposed relation to one another in an annular array, each of said cells comprising a high pressure plate having spaced integral ribs thereon defining a plurality of spaced high pressure air channels, wherein the ribs on said high pressure plate are orientated in a "C" shaped array defined by radially extending leg portions and axially extending bight portions, respectively, and the axial width of the space between adjacent radially extending ribs on said high pressure plate is directly related to the length of the space defined by the bight portion thereof, whereby air flow through each of the C-shaped channels is equal at design conditions; and a low pressure plate welded to said high pressure plate and having a plurality of spaced integral ribs which, in combination with the high pressure plate of an adjacent cell, define a plurality of low pressure exhaust gas channels, the ribs on said low pressure plate extending generally parallel to the ribs on the bight portion of the high pressure plate.

11. A recuperator for a gas turbine engine comprising:

a plurality of cells disposed in juxtaposed relation to one another in an annular array, each of said cells comprising a high pressure plate having spaced integral ribs thereon defining a plurality of spaced high pressure air channels; and a low pressure plate welded to said high pressure plate and having a plurality of spaced integral ribs which, in combination with the high pressure plate of an adjacent cell, define a plurality of low pressure exhaust gas channels; and an extended spacer bar on the radially inner edge of said low pressure plate the same height as the ribs thereon, wherein said extended spacer bar extends beyond said cell.

12. A recuperator for a gas turbine engine comprising:

a plurality of cells disposed in juxtaposed relation to one another in an annular array, each of said cells comprising a high pressure plate having spaced integral ribs thereon defining a plurality of spaced high pressure air channels; and a low pressure plate welded to said high pressure plate and having a plurality of spaced integral ribs which, in combination with the high pressure plate of an adjacent cell, define a plurality of low pressure exhaust gas channels; and an extended spacer bar on the radially inner edge of said low pressure plate the same height as the ribs thereon, wherein said extended spacer bar extends longitudinally beyond said cell at each end thereof.

13. The recuperator of claim 12 comprising a pair of cell retainer rings disposed about opposite ends of said extended spacer bars.

14. A recuperator for a gas turbine engine comprising:

a plurality of cells disposed in juxtaposed relation to one another in an annular array, each of said cells comprising a high pressure plate having spaced integral ribs thereon defining a plurality of spaced high pressure air channels; and a low pressure plate welded to said high pressure plate and having a plurality of spaced integral ribs which, in combination with the high pressure plate of an adjacent cell, define a plurality of low pressure exhaust gas channels, wherein said cells are welded to one another at only the radially inner edges thereof.

15. The recuperator of claim 14 wherein the radially outer ends of said cells are free to move relative to one another.

16. The recuperator of claim 15 comprising a cylindrical shell telescoped over the annular array of cells.

17. A recuperator for a gas turbine engine comprising:

a plurality of cells disposed in juxtaposed relation to one another, each of said cells comprising a high pressure plate having spaced integral ribs thereon defining a plurality of spaced high pressure air channels; and a low pressure plate welded to said high pressure plate and having a plurality of spaced integral ribs which, in combination with the high pressure plate of an adjacent cell, define a plurality of low pressure exhaust gas channels, wherein either at least two of said plurality of high pressure air channels or at least two of said plurality of low pressure exhaust gas channels constitute a plurality of channels having different lengths, and a spacing between ribs of at least a portion of a longer of said plurality of channels having different lengths is larger than a spacing between ribs of at least a portion of a shorter of said plurality of channels having different lengths.

18. A recuperator for gas turbine engine in accordance with claim 17 wherein the ribs on said high pressure plate are orientated in a "C" shaped array, the ribs on said low pressure plate extending generally parallel to the ribs defining the bight portion of the "C" shaped array on said high pressure plate.

19. The recuperator of claim 17, wherein said integral ribs defining said plurality of spaced high pressure air channels have substantially uniform heights from said high pressure plate, or said integral ribs defining said plurality of low pressure exhaust gas channels have substantially uniform heights from said low pressure plate.

20. The recuperator of claim 17, wherein at least a portion of said integral ribs defining said plurality of spaced high pressure air channels follows an undulating pattern, or at least a portion of said integral ribs defining said plurality of low pressure exhaust gas channels follows an undulating pattern.

21. The recuperator of claim 17, wherein at least a portion of a spaced integral rib of a high pressure plate of a first cell is located between spaced integral ribs of a low pressure plate of a second cell adjacent to said high pressure plate of said first cell, and at least a portion of a spaced integral rib of a low pressure plate of said first cell is located between spaced integral ribs of a high pressure plate of a third cell adjacent to said low pressure plate of said first cell.

22. The recuperator of claim 17 comprising a peripheral flange on said high pressure plate the same height as the ribs thereon to facilitate welding thereof to said low pressure plate.

23. A recuperator for a gas turbine engine comprising:

a plurality of cells disposed in juxtaposed relation to one another, each of said cells comprising a high pressure plate having spaced integral ribs thereon defining a plurality of spaced high pressure air channels, wherein the ribs on said high pressure plate are orientated in a "C" shaped array, and the width of the space between adjacent ribs defining the leg portion of the "C" shaped array on said high pressure plate is directly related to the length of the space defined by the bight portion thereof, whereby air flow through each of the C-shaped channels is equal at design conditions; and a low pressure plate welded to said high pressure plate and having a plurality of spaced integral ribs which, in combination with the high pressure plate of an adjacent cell, define a plurality of low pressure exhaust gas channels, the ribs on said low pressure plate extending generally parallel to the ribs defining the bight portion of the "C" shaped array on said high pressure plate.

* * * * *